US006094762A

United States Patent [19]

Viard et al.

[11] Patent Number: 6,094,762

[45] Date of Patent: Aug. 1, 2000

[54] METHOD AND APPARATUS FOR SUPPORTING AN ELEMENT TO BE SUPPORTED, IN PARTICULAR THE BODY OF A PATIENT, AND HAVING AN INTEGRATED SYSTEM FOR ACHIEVING PRESSURE EQUILIBRIUM DYNAMICALLY AND AUTOMATICALLY

[75] Inventors: Jean-Louis Viard, Grabels; Gilles Camus, Montpellier, both of France

[73] Assignee: Hill-Rom Industries, S.A., Montpellier, France

[21] Appl. No.: 09/055,096

[22] Filed: Apr. 3, 1998

[30] Foreign Application Priority Data

Feb. 9, 1998 [FR] France ..... 98 01466

[51] Int. Cl.[7] ..... A47C 27/08

[52] U.S. Cl. ..... 5/713; 5/914

[58] Field of Search ..... 5/713, 714, 715, 5/710, 914

[56] References Cited

U.S. PATENT DOCUMENTS 4,873,737 10/1989 Savenije .
5,560,374 10/1996 Viard .
5,652,484 7/1997 Shafer et al. ..... 5/713 X
5,944,066 8/1999 Viard ..... 5/713 X
5,947,168 9/1999 Viard ..... 5/713 X

FOREIGN PATENT DOCUMENTS 0 218 301 A2 4/1987 European Pat. Off. .
0 676 158 A1 10/1995 European Pat. Off. .
3804961 8/1989 Germany .

*Primary Examiner*—Terry Lee Melius
*Assistant Examiner*—William L. Miller
*Attorney, Agent, or Firm*—Wolf, Greenfield & Sacks, P.C.

[57] ABSTRACT

A method and apparatus to comfortably support a patient on an inflatable chamber. The support apparatus includes an inflatable mattress and a pump to correct the pressure of the mattress. An inflatable chamber is provided below the mattress to act as a pressure transducer. When the difference in pressure between the inflatable mattress and the inflatable sensor reaches a predetermined value, a controller actuates a correction device including a pump and a release valve to correct the pressure of the inflatable mattress. The apparatus allows the mattress to be automatically maintained at a desirable pressure.

18 Claims, 9 Drawing Sheets

MATTRESS CORRECTION CURVE P1=f(kg)

SENSOR CURVE P2=f(kg)

P1=f(P2) CURVE

P2=f(kg) SENSOR CURVE
P1=f(kg) MATTRESS CURVE

MATTRESS / PATIENT CURVE P2=f(kg)

METHOD AND APPARATUS FOR SUPPORTING AN ELEMENT TO BE SUPPORTED, IN PARTICULAR THE BODY OF A PATIENT, AND HAVING AN INTEGRATED SYSTEM FOR ACHIEVING PRESSURE EQUILIBRIUM DYNAMICALLY AND AUTOMATICALLY

The present invention relates essentially to a method and to apparatus for supporting an element to be supported, in particular the body of a patient, and having an integrated system for achieving pressure equilibrium dynamically and automatically.

BACKGROUND OF THE INVENTION

In medical practice, it is known that interface pressures constitute the main factor in the development of complications, in particular bedsores, which are a consequence of an individual at risk being kept still for a prolonged period.

More generally, interface pressures also represent an essential element in the concept of comfort.

In the prior art, support apparatus has already been proposed that comprises a support device proper for supporting an element to be supported, in particular the body of a patient, where such a support device is generally known mainly as a "mattress". Naturally, other support devices may be constituted by chairs, cushions, and seatbacks.

Such support apparatus has been described, for example, in Document EP-A-0 218 301=U.S. Pat. No. 4,873,737 or in the Applicant's prior document EP-A-0 676 158. In that prior document, the support device proper comprises at least one closed or controlled-release chamber that is flexible and inflatable to a pressure that is a function of the maximum permitted penetration distance to which the element to be supported is allowed to penetrate into the support. As a result, filling and emptying means are provided for filling or inflating said chamber so as to bring the penetration to less than the maximum permitted penetration distance.

In Document EP-A-0 218 301, it is proposed to modify the pressure when the maximum penetration depth is reached, so that penetration varies as a function of patient weight.

In the Applicant's more recent document EP-A-0 676 158, it is proposed to cause the patient to penetrate to an essentially constant depth into the support device, such as a mattress, independently of the weight of the patient, so as to allow the element to be supported, such as the body of a patient, to penetrate deeply into the support device so as to obtain better weight distribution over the area of the support, by means of a solution that uses a sensor disposed on the support device, such as a mattress, the principle of the sensor being based on the variation of the self-induction coefficient of a coil which is an integral part of an oscillator.

OBJECTS AND SUMMARY OF THE INVENTION

An object of the present invention is to solve the new technical problem consisting in providing a solution making it possible for the inflation pressure of at least one chamber provided in or constituting the support device to be regulated dynamically and automatically or substantially automatically, without using an electrical, capacitive, or inductive type detector device. The invention thus aims to provide a solution that is entirely different from previously advocated solutions, thus opening up a novel path that is particularly advantageous.

Another object of the present invention is to solve the new technical problem consisting in providing a solution making it possible for the inflation pressure of at least one chamber provided in or constituting the support device to be regulated dynamically and automatically or substantially automatically, as a function of the weight and of the morphological characteristics of the body to be supported, by comparing the pressure existing in said chamber with the pressure delivered by a suitable sensor co-operating with said chamber in a manner such as to give a coherent image of the forces which are applied thereto and of variations in said forces for the purpose of bringing the body to be supported into an equilibrium position that is optimum from the point of view of the interface pressures exerted on said body at a given instant.

Furthermore, another main object of the present invention is to solve the above-mentioned new technical problem by using a solution that is simple, and low cost, thereby making it possible to reduce manufacturing and operating costs.

Yet another object of the present invention is to solve the above-mentioned new technical problems in a manner such as to provide an effective solution whose technical and physical characteristics, and in particular whose thickness, are such that they can be used in any support device, in particular mattresses including over-mattresses, and also in cushions and in chairs, or even in other types of application, e.g. lifting and measuring.

Another main object of the present invention is to solve the new technical problem consisting in providing a solution advantageously making it possible to integrate a pressure regulation system offering high performance in a limited thickness, and in a manner that is reliable, safe, easy to implement, and low in cost, and that can be used industrially and medically.

Thus, in a first aspect, the invention provides a method of dynamically and automatically or essentially automatically regulating the inflation pressure in at least one first chamber that is flexible and inflatable, and that is provided in or that constitutes a support device, in particular a mattress, an over-mattress, a chair, a cushion, or a seat-back, the method comprising a step of detecting the inflation pressure $P_1(t)$ in said chamber at a given instant, and a step of correcting said pressure $P_1(t)$ as a function of predetermined support characteristics, wherein at least one physical pressure sensor is provided that comprises at least one second inflatable chamber inflated to a predetermined initial pressure $P_2$, and wherein said sensor is disposed relative to said support device in a manner such that the second chamber in the sensor has its pressure influenced by any change in the pressure in the first chamber in the support device, wherein the instantaneous pressure $P_2(t)$ in the second chamber in the sensor is detected at a given instant, wherein the pressure $P_1(t)$ as measured in the first chamber is compared with the pressure $P_2(t)$ as measured in the second chamber, and wherein the pressure in the first chamber is corrected when the measured pressure difference exceeds a predetermined setpoint pressure value or a predetermined range of setpoint pressure values.

In an advantageous implementation of the invention, the sensor contains at least one second chamber of substantially constant volume.

In another advantageous implementation of the invention, the initial inflation pressure of the second chamber in the sensor is set to a predetermined value, and said pressure is then left to vary freely as a function of the influence from changes in the pressure in the first chamber in the support device. Preferably, the initial pressure in the second chamber in the sensor is equal or substantially equal to atmospheric pressure.

In another advantageous implementation of the invention, the sensor comprising the second chamber is disposed under the support device comprising at least said first chamber.

In another advantageous implementation of the method of the invention, the pressure $P_1(t)$ in the first chamber is corrected whenever said pressure $P_1(t)$ departs from a predetermined value or from a predetermined range of values for the pressure $P_2(t)$ in the second chamber serving as the setpoint pressure.

In a second aspect, the present invention also provides support apparatus implementing dynamic and automatic or essentially automatic regulation of the inflation pressure $P_1$ in at least one flexible and inflatable first chamber in a support device for supporting an element to be supported, in particular the body of patient, detection means being provided for detecting the inflation pressure in said first chamber, and control means being provided for controlling correction means for correcting the pressure in said first chamber as a function of predetermined pressure characteristics, said correction means comprising first means for inflating or deflating said first chamber in said support device to a variable pressure, including a predetermined initial pressure, said apparatus comprising at least one physical pressure sensor comprising at least one second inflatable chamber that is inflated to a predetermined initial pressure $P_2$, said sensor being disposed in a manner such that the pressure in its second chamber is influenced by any change in pressure in the first chamber; means for comparing the pressure $P_1$ in said first chamber with the pressure $P_2$ in said second chamber, said control means actuating the means for correcting the pressure in said first chamber whenever the pressure difference departs from a predetermined setpoint pressure value or a predetermined range of setpoint pressure values.

Various advantageous embodiments of the apparatus result from the apparatus sub-claims, and also from the advantageous implementations of the above-mentioned method, and from the following description which is an integral part of the present invention.

It can thus be understood that the invention makes it possible to solve all of the above-mentioned technical problems in a manner that is reliable, safe, easy to implement, and cheap, and that can be used industrially and medically. Furthermore, the invention provides a solution advantageously making it possible to integrate the various means or devices of the invention into a pressure-regulating system offering performance in a limited thickness, thereby making it possible in turn to limit the overall size of the support apparatus.

BRIEF DESCRIPTION OF THE DRAWINGS

Other objects, characteristics, and advantages of the invention appear clearly on reading the following explanatory description made with reference to a presently preferred embodiment of the invention given merely by way of illustration and therefore in no way limiting the scope of the invention.

In the context of the present description and of the claims, the pressure is atmospheric pressure and the temperature is ambient temperature, unless otherwise indicated. In the drawings:

MORE DETAILED DESCRIPTION

Figure 1:
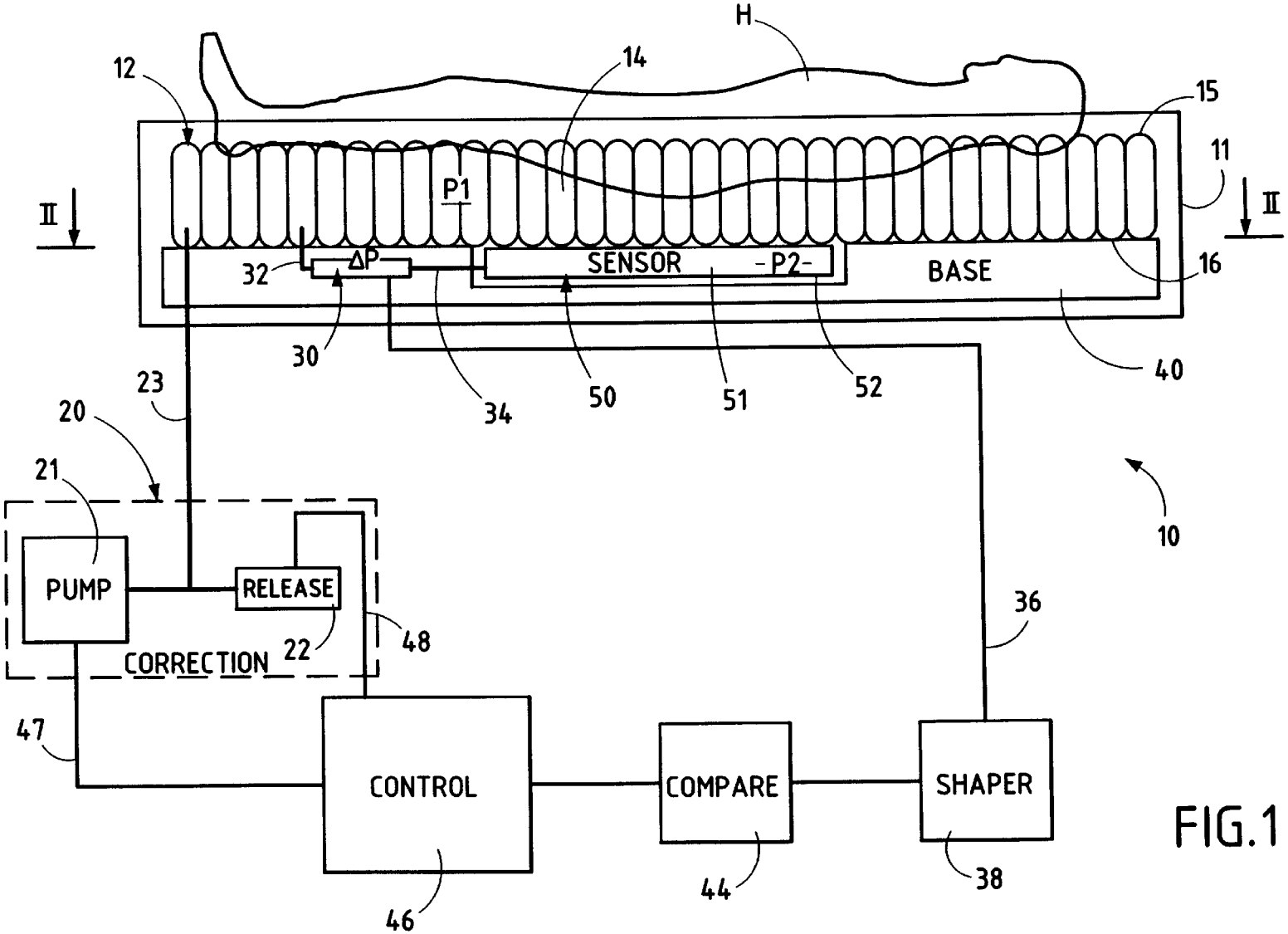
FIG. 1 is a diagram showing a presently preferred embodiment of support apparatus of the present invention, comprising a support device having a single chamber.
Figure 2:
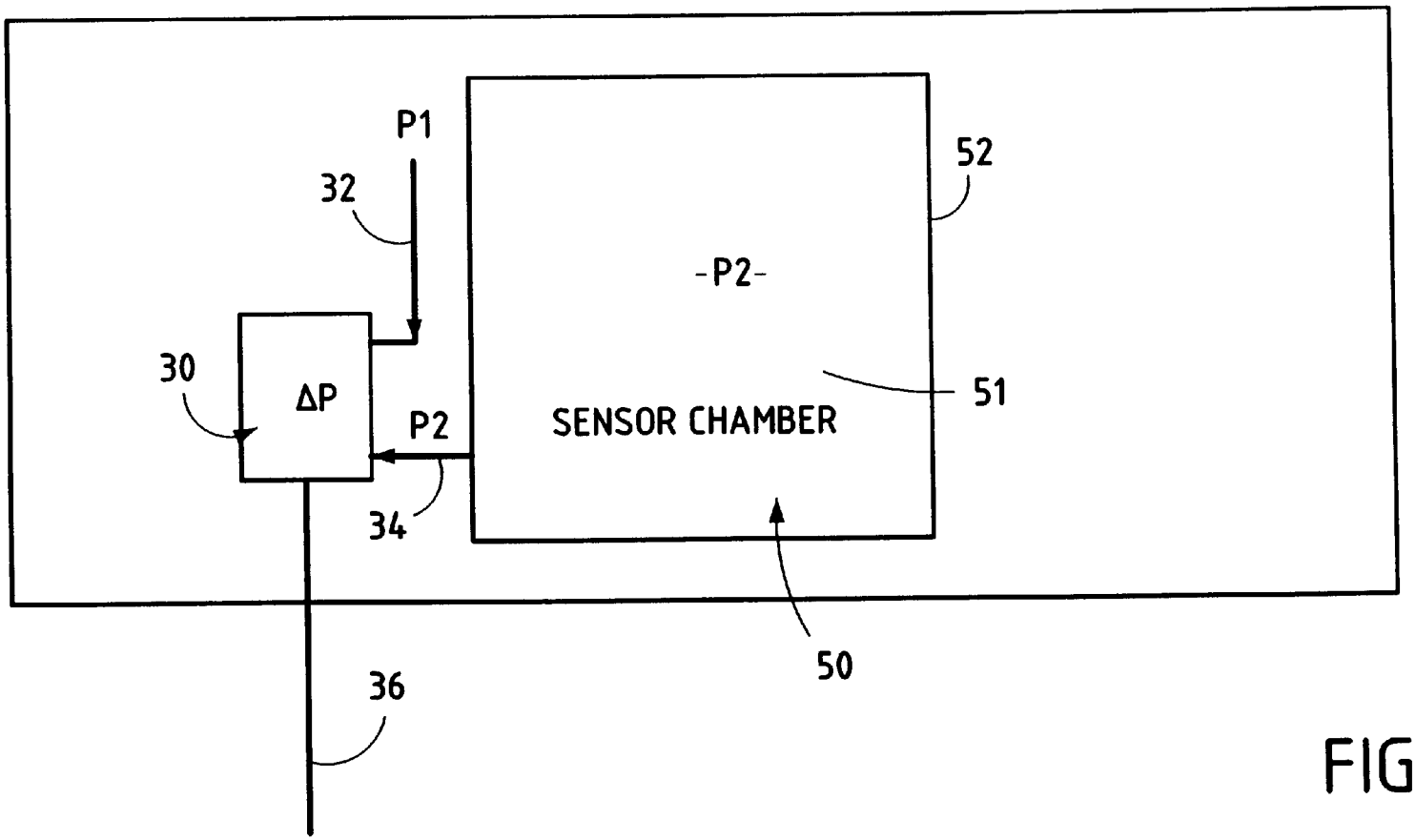
FIG. 2 is a detail plan view on a plane II—II of FIG. 1 showing the sensor and the electronic system comprising associated pressure detection and comparison means.

With reference to FIG. 1, support apparatus of the present invention is shown under the overall reference 10. This support apparatus makes it possible to support an element to be supported, in particular, as shown, the body of a patient such as a human being H.

The apparatus 10 includes a support device proper 12 comprising at least one closed or controlled-release chamber 14 that is inflatable and flexible. For example, the chamber may be made up of a multitude of inflatable tubes that communicate with one another, said chamber 14 being inflatable to an inflation pressure $P_1$. At the beginning of operation, the chamber 14 is not necessarily inflated, but it is more practical to start with an initial pressure, for example in the vicinity of the pressure in the second chamber 51 described below. The chamber 14 has a top face 15 serving to support the element to be supported H, and a bottom face 16 which may, for example, in this case rest on a base given the overall reference 40 which itself may rest directly or indirectly on a bed structure (not shown). The assembly comprising the device 12 and the base element 40 may be contained in a cover 11.

The apparatus further comprises control means 30 for controlling correction means 20 that servo-control the filling pressure $P_1$ to which the chamber 14 is filled with a filling fluid, in particular air. This is done by pumping means 20 comprising filling means proper 21 such as a compressor for filling the chamber 14, and emptying means 22 such as a controlled-release valve, connected to the chamber 14 via a suitable pipe 23.

Pressure measurement means 31 are also provided in particular for measuring the pressure $P_1$ in the first chamber 14, and are connected to the first chamber 14 via a suitable pipe 32.

In the context of the present invention, the apparatus 10 also comprises a physical pressure sensor 50 comprising at least one second inflatable chamber 51 inflated to a predetermined initial pressure $P_2$. The sensor 50 is connected via a duct 34 to the pressure measurement means 31 which also comprise, in integrated manner, pressure comparator means 38 for comparing the pressure $P_1$ in the first chamber 14 (in the support device 12) with the pressure $P_2$ in the second chamber 51 (in the sensor 50). In the context of the invention, the physical pressure sensor 50 is disposed relative to the support device 12 in a manner such that its pressure $P_2(t)$ in the chamber 51 is influenced by a change in the pressure $P_1(t)$ in the first chamber 14, in the support device 12. In other words, while remaining independent, the sensor 50 gives a pressure value $P_2(t)$ that continuously delivers a coherent image of the pressure $P_1(t)$ in the first chamber 14 (in the support device 12).

According to an advantageous characteristic of the invention, the sensor 50 comprises a closed bag 52 that is flexible and that defines the chamber 51 whose volume, once said chamber 51 has been filled with an inert fluid such as distilled and treated water, silicone oil, or any other suitable fluid, is substantially constant so that the sensor acts as a genuine mechanical pressure transducer.

It should be noted that, in the context of the invention, the chamber 14 has its own filling means 21 and emptying means 22.

Figure 3:
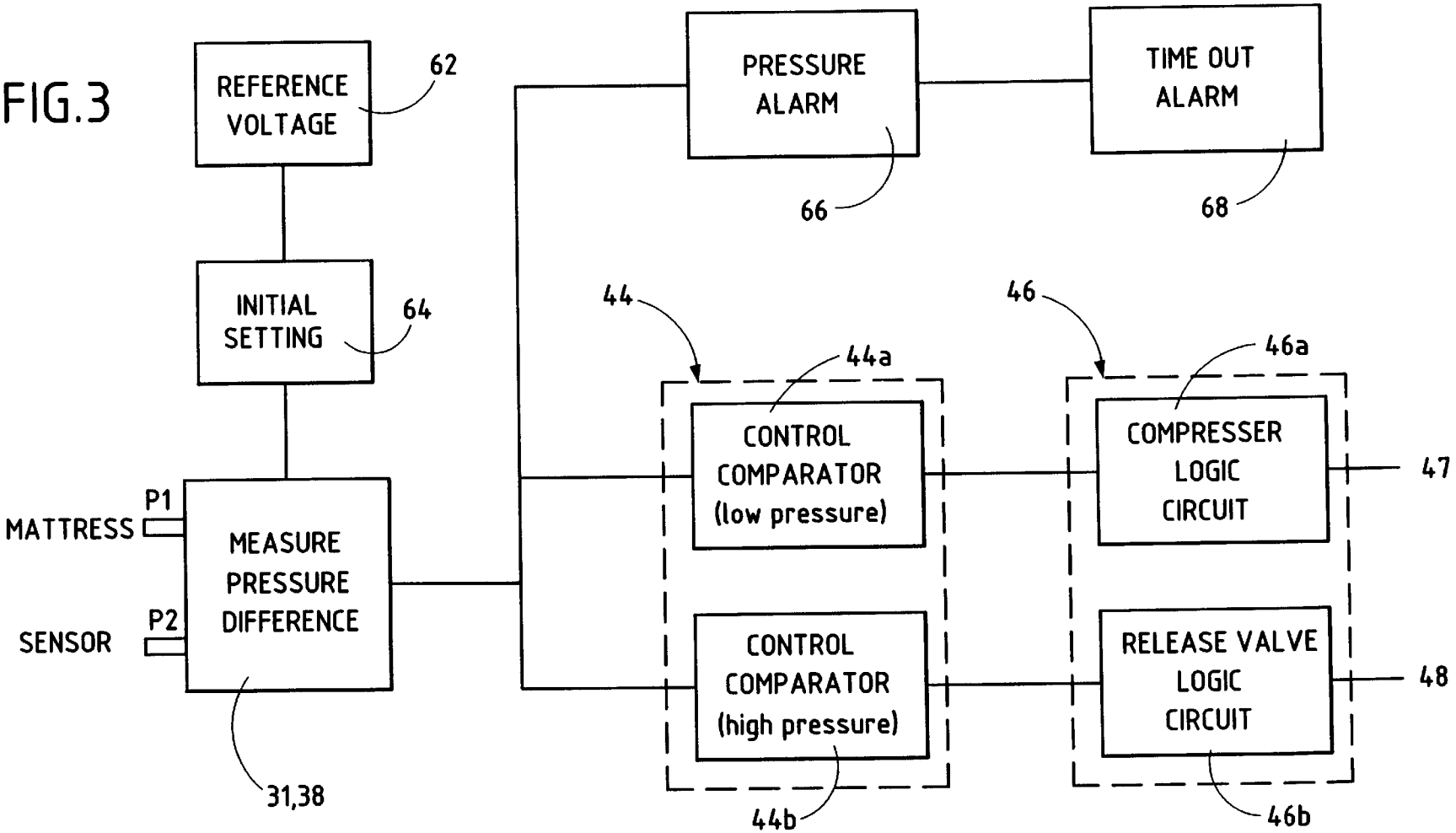
FIG. 3 is a block diagram of the control means for controlling the apparatus.
Figure 4:
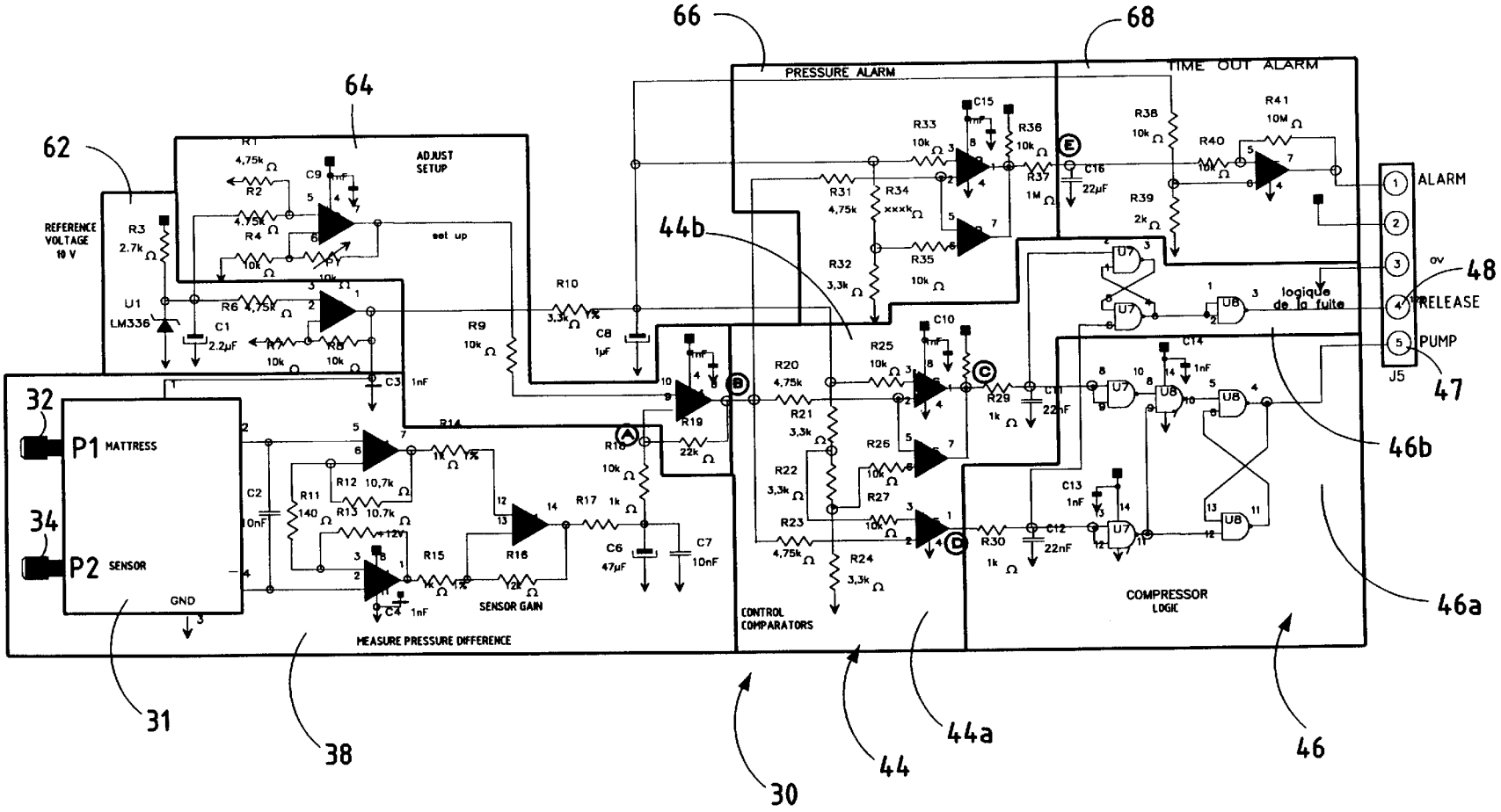
FIG. 4 shows the electronic circuit of apparatus for dynamically and automatically or substantially automatically regulating the pressure in the support device, the circuit implementing the functions defined in FIG. 3.

It can be understood from FIGS. 3 and 4 that the pressure measurement means 31 which advantageously measure the difference between the pressures $P_1(t)$ and $P_2(t)$ respectively in chamber 14 and in chamber 51, are an integral part of the control means 30, continuously converting the differential pressure value $P_1(t)-P_2(t)$ into an electrical signal by suitable means shown in FIG. 3, and delivering a voltage via the shaping circuit 38, to the control circuit 44, making it possible to implement separate control logic circuits 45*a*, 45*b* contained in the actual control circuit 46 for controlling via respective logic circuits 46*a*, 46*b* and via the ducts 47 and 48, the filling means 21 for filling the chamber 14 and the emptying means 22 for emptying it, as a function of the pressure information $P_2(t)$ delivered by the chamber 51 of the sensor 50, thereby automatically or substantially automatically achieving dynamic equilibrium between the pressures in the manner desired.

The set of circuits constituting the control means 30 for controlling the means 20 for filling the chamber 14 with the fluid and for emptying it can be clearly understood by a person skilled in the art on inspecting the electronic circuit shown in FIG. 3 which is fully incorporated into the description by reference and is an integral part of the present invention. Measurement and comparator means 31 for delivering an output voltage Vs are well known to a person skilled in the art and are commercially available.

It can thus be understood that the sensor 50 is made up of the bag 52 defining the chamber 51 for sensing pressure $P_2(t)$, and of an electronic circuit 30 constantly converting the pressure difference $P_1(t)-P_2(t)$ between the chamber 14 and the chamber 52 so as to cause the pressure in the chamber 14 to be regulated automatically by controlling the means 20 comprising the fluid filling means 21 and the fluid emptying means 22.

Naturally, it is quite possible, in another embodiment, to provide an electronic circuit 30 for separately sensing the pressures $P_1$ and $P_2$ respectively in the first chamber 14 and in the second chamber 51, for converting the pressures into electrical signals, and then for comparing said signals for the purposes of automatically controlling the means 20 for filling the chamber 14 with fluid and for removing fluid therefrom.

In medical practice, this type of pressure sensor 50 associated with the support device 12 and co-operating with an alarm system may also be used for patient monitoring, to detect whether the patient leaves or falls out of the bed.

Furthermore, at rest, it is presently preferred for the second chamber 51, in the physical pressure sensor 50, to be filled to a pressure $P_2$ in the vicinity of or equal to atmospheric pressure, so that:

a) since the volume of the chamber 51 remains constant or essentially constant, the response of the physical pressure sensor 50 is linear in the pressure measurement range in question;

b) the comfort of the patient and the performance of the support device 12 are not jeopardized from the outset by a high pressure in the chamber 51 and by a perceptibly hard surface;

c) a reference is established for the system that is easy to reproduce and to control, and that constitutes the zero point for the measurement system; and d) the amplitude of the response of the sensor 50 and therefore the resolution thereof is increased to as high as possible.

Naturally, a sensor 50 having its initial pressure P2 in the chamber 51 set to any predetermined pressure value that is different from atmospheric pressure would constitute another type of embodiment which is perfectly useable, in particular in other applications.

It can also be understood that the apparatus of the invention behaves like a logic system having three states:

a) at rest at a given pressure $P_1$ in the first chamber 14 in the support device 12;

b) inflation of the chamber 14; or c) deflation of the chamber 14.

At rest, the pressure $P_1$ in the first chamber 14 is equal to the pressure $P_2$ in the second chamber 51, in the sensor 50.

Naturally, this applies to the present embodiment, but other embodiments may be at rest when there is a difference between the pressures $P_1$ and $P_2$.

When, at a given instant (t), a pressure $P_1(t)$ is established in the first chamber 14, e.g. by the body of a human being H weighing down against the top face 15 of the chamber 14, or being withdrawn therefrom, this pressure is transmitted to the bag 52 defining the second chamber 51 which reacts with a pressure $P_2(t)$.

The pressure $P_1(t)$ is compared with the pressure $P_2(t)$.

If the pressure difference $P_1(t)-P_2(t)$ is less than a small negative threshold (−e) that is determined a priori, then the filling means 21, such as a compressor, are actuated so as to re-establish pressure equilibrium to between the set thresholds by inflating the chamber.

b) If the pressure difference $P_1(t)-P_2(t)$ is greater than a small positive threshold (+e) that is determined a priori, then the emptying means 22, such as a release valve, are actuated so as to re-establish pressure equilibrium to between the set thresholds by deflating the chamber 14.

c) If the pressure difference $P_1(t)-P_2(t)$ lies between the thresholds, i.e. within the range ±e as determined a priori, then nothing happens, and the pressures $P_1$ and $P_2$ are considered to be close together.

The filling means 21 or the emptying means 22 are caused to operate for a certain length of time Dt until instantaneous pressure equilibrium is re-established within the predetermined range, i.e. until $P_1(t+Dt)$ lies in the range $P_2(t+Dt)$ −e to $P_2(t+Dt)$+e.

The hysteresis of the system makes it possible to achieve regulation between the lower and upper thresholds of the set zone, and avoids undesirable hunting phenomena.

Thus, the sensor 50 associated with the electronic measurement device 30 delivers an electrical signal that is proportional to the pressure difference $P_1(t)-P_2(t)$ between the first chamber 14 in the support device 12 and the second chamber 51 in the sensor 50, which pressure difference results from the body, in this example the body of a human being H, penetrating into the chamber 14.

This electrical signal represents the instantaneous setpoint of the system in dynamic equilibrium and about which the pressure in the chamber 14 is regulated, with automatic real time correction so as to ensure that the pressure in the second chamber 51 in the bag 52 of the sensor 50, and the pressure in the first chamber 14 in the support device proper 12, are in equilibrium.

Each setpoint corresponds to a given regulation pressure, and therefore to a position of the body in the chamber 14 as a function of the weight and of the morphological characteristics specific to the body.

Pressure regulation is achieved by the fluid filling means and by the fluid emptying means, in particular on an on/off basis, by means of the compressor 21 and of the controlled-release valve 22.

The response of the system is as fast as the sensor 50 and the electronic control station 30 coupled to the fluid-filling means 21 and to the fluid-emptying means 22 can be.

To conclude, it can be understood that an automatic pressure-regulation system is obtained that is suited to the body, in particular the body of a patient H, supported by the support device 12.

As regards the electronic control station shown in FIG. 4, its circuit is part of the invention, it is therefore fully integrated into the description, and it operates as follows:

a) Differential pressure measurement stage (reference 38, FIGS. 3 and 4)

In this case, as can be well understood by a person skilled in the art, the circuit is based on the use of a differential pressure sensor receiving, at an instant t, firstly the pressure $P_1(t)$ of the chamber 14, and secondly the pressure $P_2(t)$ of the chamber 51. After amplification, the signal appearing at A represents an instantaneous voltage that is proportional to the pressure difference $P_1(t)-P_2(t)$.

b) 10 V reference voltage stage (reference 62, FIGS. 3 and 4)

The 10 V reference voltage is used for the control and alarm comparators. It is also used to feed the electrical pressure sensor 31 with a pressure "U3".

c) Set-up adjustment stage (reference 64, FIGS. 3 and 4)

Initial adjustment makes it possible to offset the signal of point A so as to take up any dispersion due to the sensor 50, or to the electronic components. The signal obtained at point B is thus the point A signal plus the initial adjustment signal.

The electrical signal obtained at point B is thus the point A signal plus the set-up signal.

d) Control comparators (reference 44, FIGS. 3 and 4)

The comparators make it possible to separate control of the compressor 21 from control of the release valve 22.

They also implement a logic circuit having three stable states with a hysteresis of ±1 inch of water pressure, corresponding to 1.9 mm Hg, i.e. of mercury pressure expressed in millimeters, or equivalent to 2.54 mbars.

i) If the pressure difference $P_1(t)-P_2(t)$ is less than −1" $H_2O$, i.e. if the pressure in chamber 14 is too low compared with the pressure in the second chamber 51, in the sensor 50, point D goes to the high state, and the compressor 21 is actuated.

ii) If the pressure difference $P_1(t)-P_2(t)$ is greater than +1" $H_2O$, i.e. if the pressure in chamber 14 is too high compared with the pressure in the sensor 50, point C goes to the high state, and the release valve 22 is actuated.

iii) If the pressure difference $P_1(t)-P_2(t)$ lies in the range −1" $H_2O$ to +1" $H_2O$, i.e. if the pressure in chamber 14 is relatively close to the pressure in the sensor 50, then both point C and point D go to the low state, and neither the release valve 22 nor the compressor 21 are actuated.

e) The logic circuits of the compressor 21 and the logic circuit of the release valve 22

(references 46*a*, 46*b*, FIGS. 3 and 4)

They make it possible to lock the control of the release valve 22 and of the compressor 21 without hunting, and to obtain clear positive control.

f) Pressure alarm (reference 66, FIGS. 3 and 4)

A pressure alarm may be triggered when the pressure difference $P_1(t)-P_2(t)$ is well outside the regulation range, the alarm value being, for example, ±2" $H_2O$.

g) Alarm time-delay (reference 68, FIGS. 3 and 4)

The alarm signal present at point E is delayed before it activates the alarm proper, so as not to take into account rapid variations in pressure, such as, for example, those resulting from the patient moving.

Responses of the various elements $P_1=f(P_2)$

The responses of the elements are shown by the curves of the graphs in FIGS. 5 to 8.

With the presently preferred embodiment shown in FIGS. 1 to 4, the experimental reaction curve of the support device 12 (a mattress in this case) was obtained in the form of a graph in which the pressure $P_1$ in the mattress is plotted as a function of the load in kilograms applied to and centered on the sensor 50, the sensor 50 being decoupled from the mattress 12, the initial pressure being set at 1.4" $H_2O$ for reasons of convenience;

The curve obtained shows that the pressure response of the mattress 12 is linear in the range in question.

Figure 6:
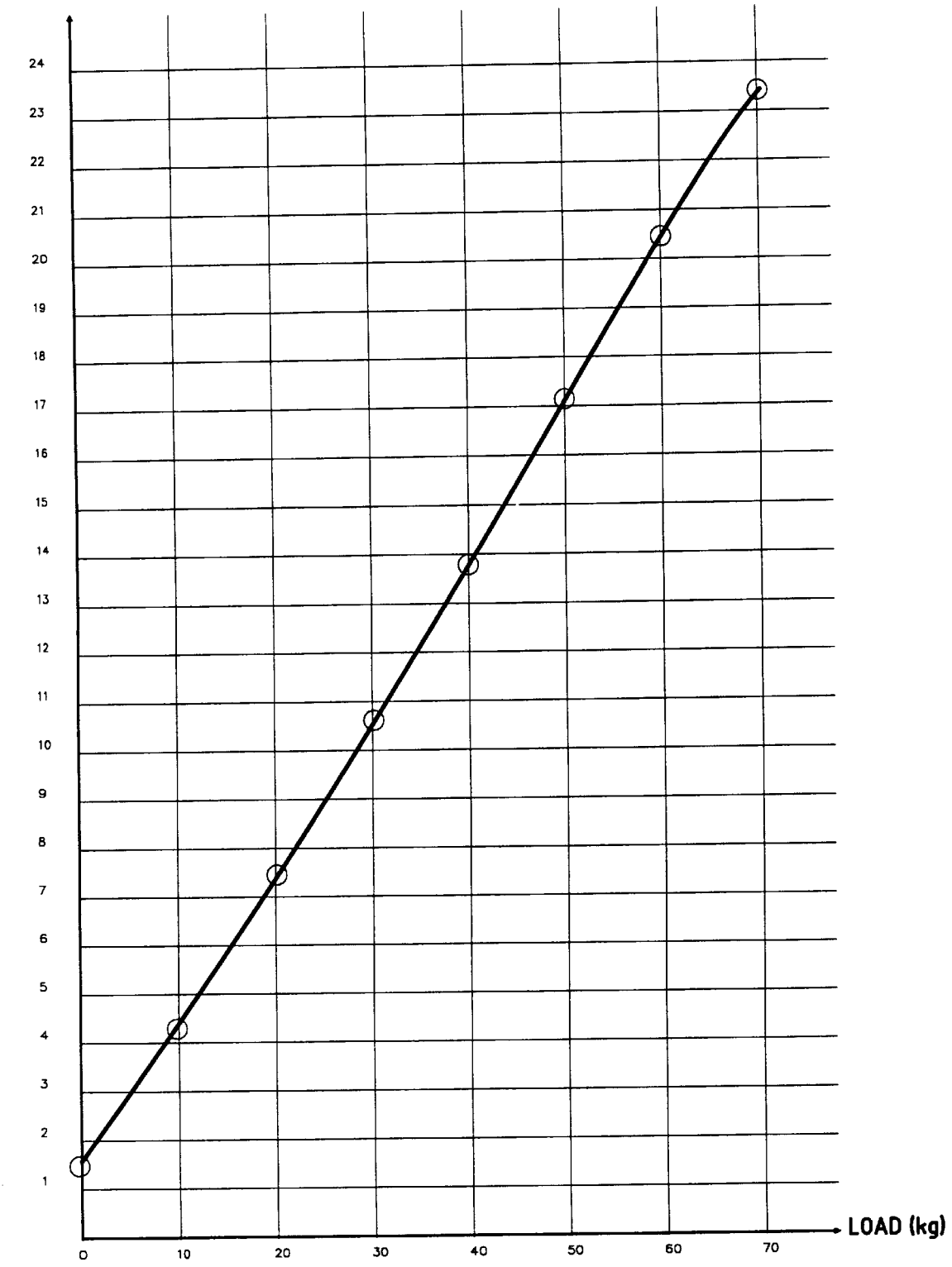
FIG. 6 is a graph showing a curve analogous to the curve shown in FIG. 5, for the sensor 50 having an initial height of 30 mm and inflated to an initial pressure of 1.0 inch $H_2O$=2.54 mbars, as a function of the load in kilograms weight expressed along the x-axis, applied directly to the center of the sensor 50.

Similarly, it can be observed from FIG. 6 that the response curve of the sensor in terms of pressure $P_2$ as a function of the load expressed in kilograms with a sensor having a height of 30 mm, and an initial pressure of 1.0" $H_2O$ as a function of the load applied to and centered on the sensor 50 shows that the function is also linear in the range in question.

Figure 5:
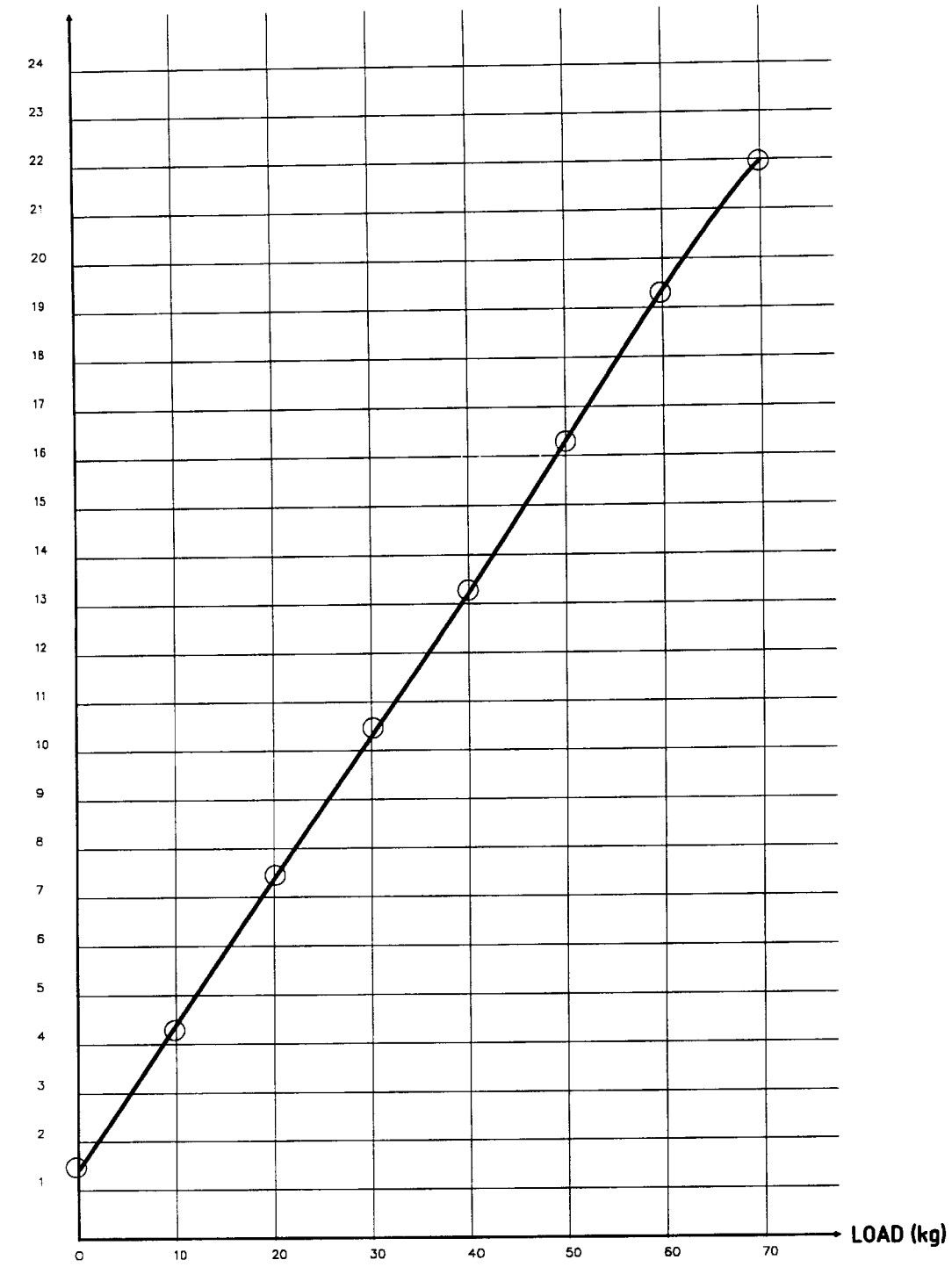
FIG. 5 is a graph showing a curve of the separate response of the mattress constituting, in this case, the support device 12, in pressure $P_1$, plotted up the y-axis, in inches of water (equivalent to units of 2.54 mbars), as a function of the load applied directly to the center of the pressure sensor 50 expressed in kilograms weight and plotted along the x-axis, the sensor 50 being physically decoupled from the mattress 12.
Figure 7:
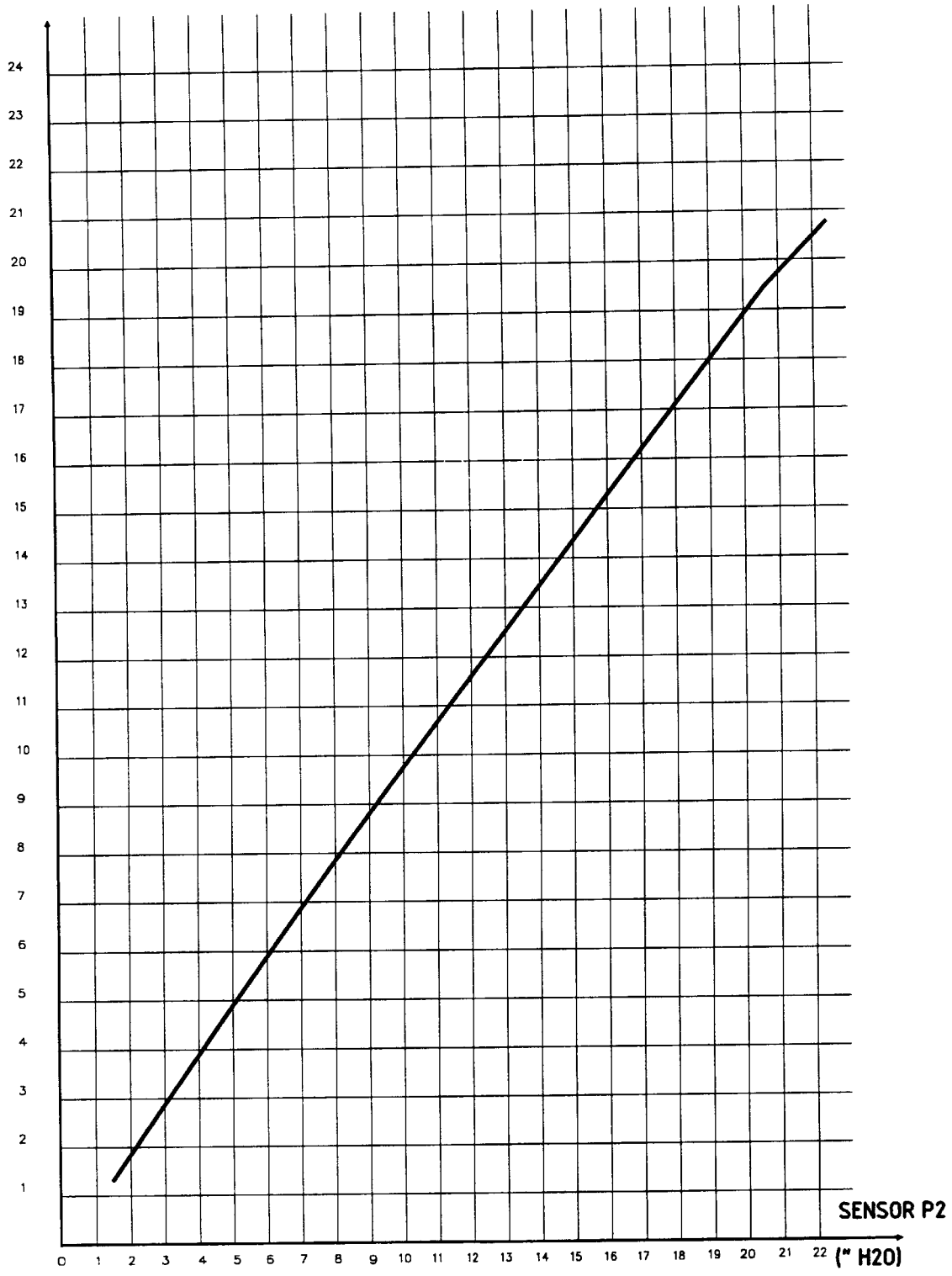
FIG. 7 is a graph showing a pressure curve analogous to tie those of FIGS. 5 and 6 but representing, plotted up the y-axis, the pressure values $P_1$ of the mattress 12 obtained in FIG. 4 as a function of the pressure values $P_2$ of the sensor 50 as obtained in FIG. 5, and plotted along the x-axis, with, as a parameter, the load applied to the sensor 50, i.e. $P_1=f(P_2)$.

The curve shown in FIG. 7 gives the pressure $P_1$ of the mattress 12 as a function of the pressure $P_2$ in the sensor 50, namely $P_1=f(P_2)$, and was obtained from the pressure values of FIGS. 5 and 6. It makes it possible to observe that the functions substantially coincide in the range in question, which is easy to demonstrate in the range in question by the almost linear nature of the experimental transfer function $P_1=f(P_2)$ which is of the type $P_1=k'P_2$, where k is a coefficient in the vicinity of 1.

This makes it possible to show that, in the context of the invention, a system for achieving dynamic equilibrium between the pressures $P_1$ and $P_2$ does actually exist.

Figure 8:
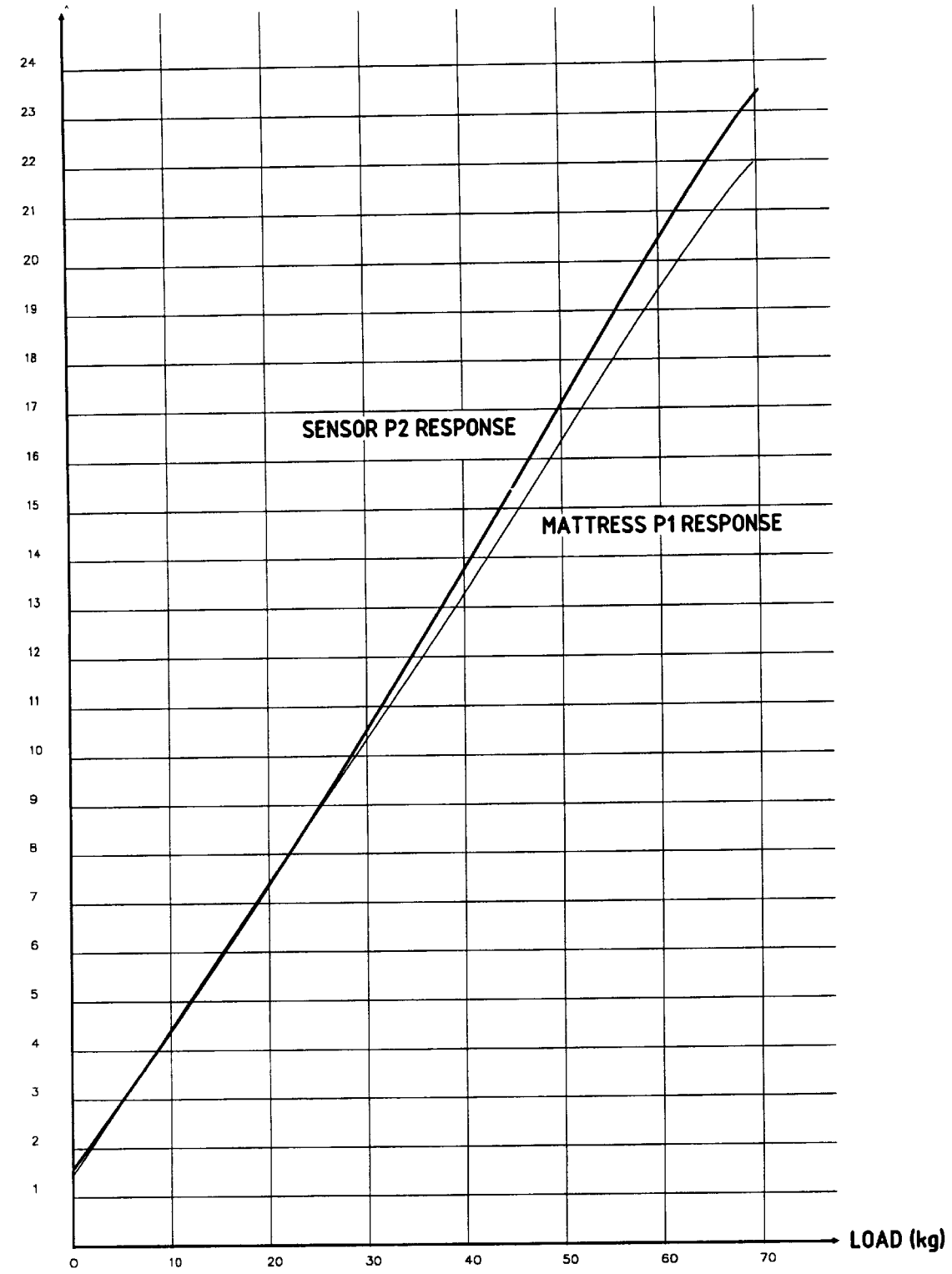
FIG. 8 is a graph showing the response dynamic pressure value $P_1$ or $P_2$ respectively of the mattress 12 and of the sensor 50, expressed up the y-axis in inches of water (equivalent to units of 2.54 mbars), as a function of the real load applied on the mattress forming the support device 12, such as, in this case, a patient H, the weight of whose body applies a load expressed in kilograms plotted along the x-axis with a first measurement point at an initial pressure of 1.4 inches of $H_2O$=1.4×2.54 mbars.

FIG. 8 shows the experimental response curve of the system $P_1=f(P_2)$Compared with the experimental results, the curves obtained under real operating conditions make it possible to observe the influence of the morphological data for a given population representative of the morphological characteristics of the population at risk, as well as the influence of inclining the rest plane.

Figure 9:
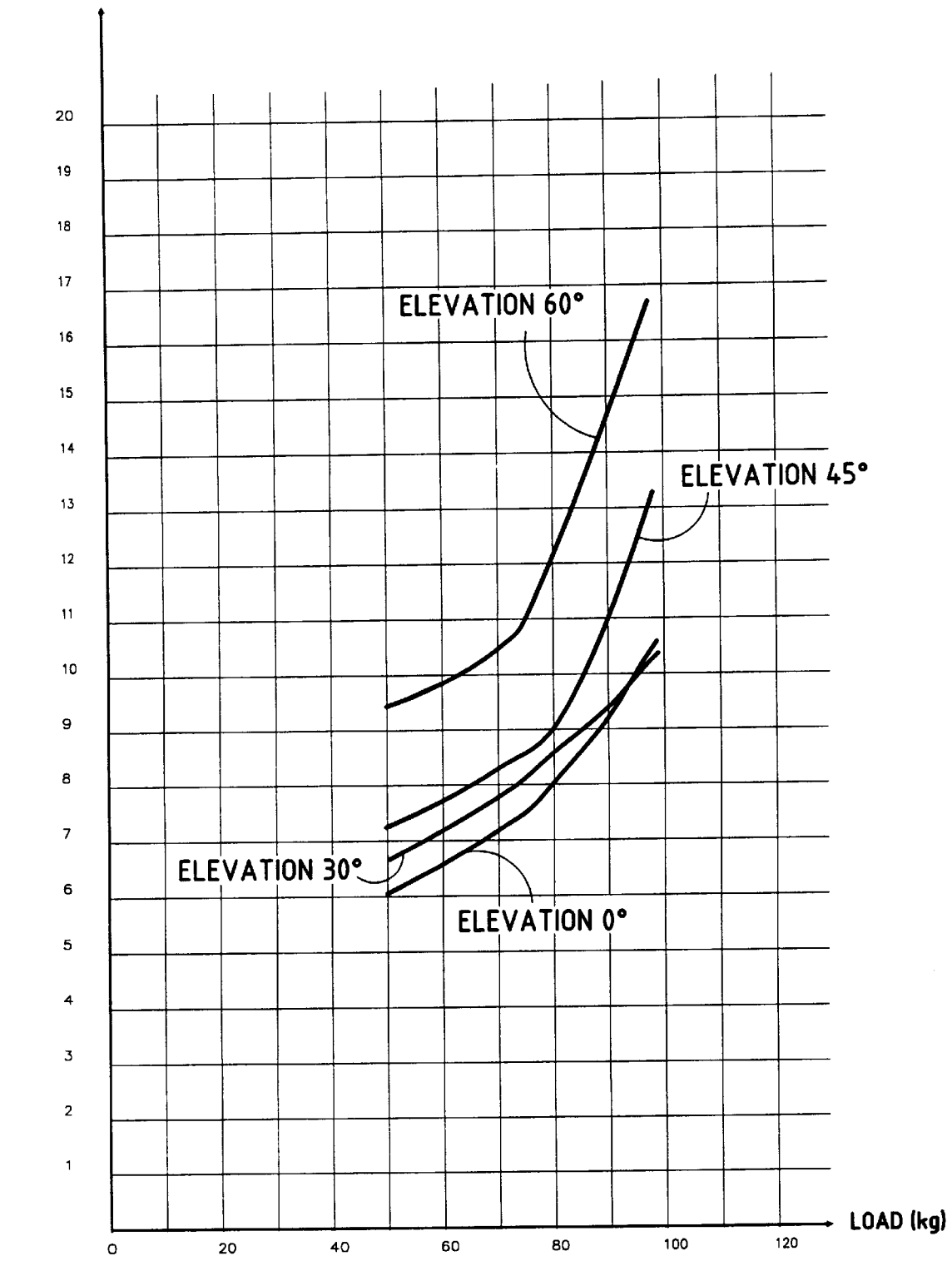
FIG. 9 shows the response curves obtained under real operating conditions for various angles of the back-raising portion of a bed hinged to be inclinable at 0°, 30°, 45°, and 60°, and for all body weights from 50 kg to 100 kg, with interface pressures $P_1$ in the chamber 14 of the mattress whose values show the effect of the regulation in the range in question.

With reference to FIG. 9, it can be observed that the curves are essentially the same in appearance, e.g., for all of the angles of the back-raising portion of a bed hinged to be inclinable at 0°, 45°, and 60°, and for all body weights in the range 50 kg to 100 kg, with interface pressures $P_1$ in the chamber 14 in the mattress whose values show the effect of regulation in the range in question.

Thus, the invention does indeed make it possible to implement the method of dynamically and automatically regulating the pressures in a manner that is safe, reliable, and cheap, and that can be used industrially and commercially, as mentioned above.

Naturally, the invention covers all of the technical means described and shown in the Figures, which Figures (1 to 9) are integral parts of the present invention. The invention also covers any technical means constituting technical equivalents of the means described, and the various combinations thereof.

What is claimed is:

1. A method of dynamically and automatically or essentially automatically regulating the inflation pressure in at least one first chamber that is flexible and inflatable, and that is provided in or that constitutes a support device, the method comprising a step of detecting the inflation pressure $P_1(t)$ in said chamber at a given instant, and a step of correcting said pressure $P_1(t)$ as a function of predetermined support characteristics, wherein the improvement comprises providing at least one physical pressure sensor comprising at least one second inflatable chamber inflated to a predetermined initial pressure $P_2$, wherein disposing said pressure sensor relative to said support device in a location where the second chamber in the pressure sensor has its pressure influenced by any change in the pressure $P_1(t)$ in the first chamber, in the support device, detecting the instantaneous pressure $P_2(t)$ in the second chamber in the sensor at a given instant, comparing the pressure $P_1(t)$ as measured in the first chamber with the pressure $P_2(t)$ as measured in the second chamber, and correcting the pressure in the first chamber when the measured pressure difference exceeds a predetermined setpoint pressure value or a predetermined range of setpoint pressure values.

2. The method of claim 1, wherein the at least one second chamber is of substantially constant volume.

3. The method of claim 1, wherein the initial inflation pressure $P_2$ of the second chamber in the pressure sensor is set to a predetermined value, and said pressure $P_2(t)$ is then left to vary freely as a function of the influence of changes in the pressure $P_1(t)$ in the first chamber in the support device.

4. The method of claim 1, wherein the initial pressure $P_2$ in the second chamber in the sensor is equal or substantially equal to atmospheric pressure.

5. The method of claim 1, wherein the pressure sensor comprising the second chamber is disposed under the support device comprising at least the first chamber.

6. The method of claim 1, wherein the pressure $P_1(t)$ in the first chamber is corrected whenever said pressure $P_1(t)$ departs from a predetermined value or from a predetermined range of values for the pressure $P_2(t)$ in the second chamber serving as the setpoint pressure.

7. The method of claim 1, wherein the support of a patient confined to bed on a device comprises a mattress or an over-mattress and wherein the method is regulated, for preventing or treating bed sores.

8. A support apparatus implementing dynamic and automatic or essentially automatic regulation of the inflation pressure in at least one flexible and inflatable first chamber in a support device for supporting an element to be supported, detection means being provided for detecting the inflation pressure $P_1(t)$ in said first chamber at a given instant, and control means being provided for controlling correction means for correcting the pressure $P_1(t)$ in said first chamber as a function of predetermined pressure characteristics, said correction means comprising first means for inflating or deflating said first chamber in said support device to a variable pressure, including a predetermined initial pressure, said apparatus further comprising at least one physical pressure sensor comprising at least one second inflatable chamber that is inflated to a predetermined initial pressure $P_2$, said pressure sensor being disposed under the first chamber, the pressure $P_2(t)$ in the second chamber being influenced by any change in pressure $P_1(t)$ in the first chamber; means for comparing the pressure $P_1(t)$ in the first chamber with the pressure $P_2(t)$ in the second chamber, and said control means actuating the means for correcting the pressure $P_1(t)$ in the first chamber whenever the pressure difference $P_1(t)-P_2(t)$ departs from a predetermined setpoint pressure value or a predetermined range of setpoint pressure values.

9. The apparatus of claim 8, wherein the at least one second chamber is of substantially constant volume.

10. The apparatus of claim 8, wherein the initial inflation pressure $P_2$ of the second chamber in the pressure sensor is set to a predetermined value, and said pressure $P_2(t)$ is then left to vary freely as a function of the influence of changes in the pressure $P_1(t)$ in the first chamber in the support device.

11. The apparatus of claim 8, wherein the initial pressure $P_2$ in the second chamber in the sensor is equal or substantially equal to atmospheric pressure.

12. The apparatus of claim 8, wherein said correction means correct the pressure $P_1(t)$ in the first chamber whenever said pressure $P_1(t)$ departs from a predetermined value or from a predetermined range of values for the pressure $P_2(t)$ in the second chamber serving as the setpoint pressure.

13. A support apparatus comprising:

at least one inflatable first chamber at an inflation pressure $P_1(t)$;

a pressure detector to detect the inflation pressure $P_1(t)$ in said first inflatable chamber;

at least one physical pressure sensor comprising a second chamber pressurized to a predetermined pressure $P_2$, said sensor having a pressure $P_2(t)$ at a given instant;

a corrector connected to said inflatable first chamber to correct the pressure $P_1(t)$ in said inflatable first chamber as a function of desired pressure characteristics;

an apparatus for comparing pressure $P_1(t)$ and pressure $P_2(t)$;

wherein said corrector is actuated in response to the apparatus for comparing when the difference between pressure $P_1(t)$ and pressure $P_2(t)$ departs from a predetermined pressure setpoint value or a range of predetermined setpoint pressure values;

and wherein said physical pressure sensor is disposed in a location where the pressure $P_2(t)$ in the second chamber is influenced by any change in pressure $P_1(t)$ in the first chamber;

and wherein the initial pressure $P_2$ of the second chamber is set to a predetermined value, and the pressure $P_2(t)$ is left to vary freely as a function of the influences of changes in the pressure $P_1(t)$ in the first chamber of the support device.

14. The apparatus of claim 13 wherein the second chamber of the physical pressure sensor is of substantially constant volume.

15. The apparatus of claim 13, wherein the initial pressure $P_2$ in the second chamber in the physical pressure sensor is equal or substantially equal to atmospheric pressure.

16. The apparatus of claim 13, wherein the physical pressure sensor is disposed under the first inflatable chamber.

17. The apparatus of claim 13, wherein said corrector corrects the pressure $P_1(t)$ in the first inflatable chamber whenever said pressure $P_1(t)$ departs from a predetermined value or from a predetermined range of values for the pressure $P_2(t)$ in the second chamber, said pressure $P_2(t)$ serving as the setpoint pressure.

18. A support apparatus comprising:

at least one inflatable first chamber at an inflation pressure $P_1(t)$;

a pressure detector to detect the inflation pressure $P_1(t)$ in said first inflatable chamber;

at least one physical pressure sensor comprising a second chamber pressurized to a predetermined pressure $P_2$, said sensor having a pressure $P_2(t)$ at a given instant;

a corrector connected to said inflatable first chamber to correct the pressure $P_1(t)$ in said inflatable first chamber as a function of desired pressure characteristics;

an apparatus for comparing pressure $P_1(t)$ and pressure $P_2(t)$;

and wherein said physical pressure sensor is disposed in a location where the pressure $P_2(t)$ in the second chamber is influenced by any change in pressure $P_1(t)$ in the first chamber;

and wherein said corrector corrects the pressure $P_1(t)$ in the first chamber in response to the apparatus for comparing when said pressure $P_1(t)$ departs from a predetermined value or from a predetermined range of values for the pressure $P_2(t)$ in the second chamber, said pressure $P_2(t)$ serving as the setpoint pressure.

* * * * *